United States Patent [19]

Kaya et al.

[11] Patent Number: 4,704,805

[45] Date of Patent: Nov. 10, 1987

[54] SUPERVISORY CONTROL SYSTEM FOR CONTINUOUS DRYING

[75] Inventors: Azmi Kaya, Akron; Larry Rice, Gates Mills, both of Ohio

[73] Assignee: The Babcock & Wilcox Company, New Orleans, La.

[21] Appl. No.: 921,917

[22] Filed: Oct. 20, 1986

[51] Int. Cl.[4] ..... F26B 21/06

[52] U.S. Cl. ..... 34/31; 34/34; 34/46; 34/48; 34/54; 34/56

[58] Field of Search ..... 34/46, 48, 54, 56, 50, 34/26, 28, 29, 36, 31, 34

[56] References Cited

U.S. PATENT DOCUMENTS

| | | | |
|---|---|---|---|
| 4,356,641 | 11/1982 | Rosenan | 34/46 |
| 4,386,471 | 6/1983 | Bowrey et al. | 34/46 |
| 4,599,808 | 7/1986 | Gelinean et al. | 34/46 |

*Primary Examiner*—Larry I. Schwartz

*Attorney, Agent, or Firm*—Vytas R. Matas; Robert J. Edwards

[57] ABSTRACT

Supervisory control system including an arrangement and process for controlling the operation of a dryer for the continuous adiabatic drying of a moist solid product with heated air for achieving the desired final product moisture content which would not exceed scorch level.

15 Claims, 8 Drawing Figures

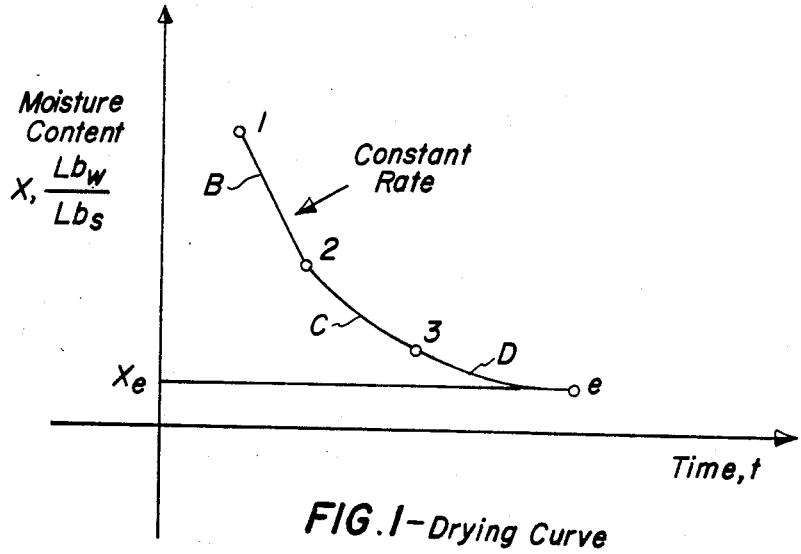
FIG. 1-Drying Curve
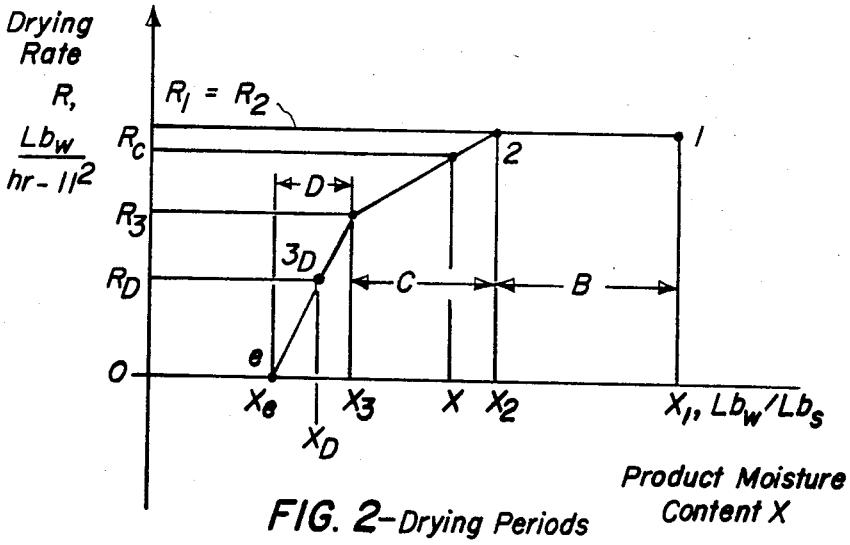
FIG. 2-Drying Periods

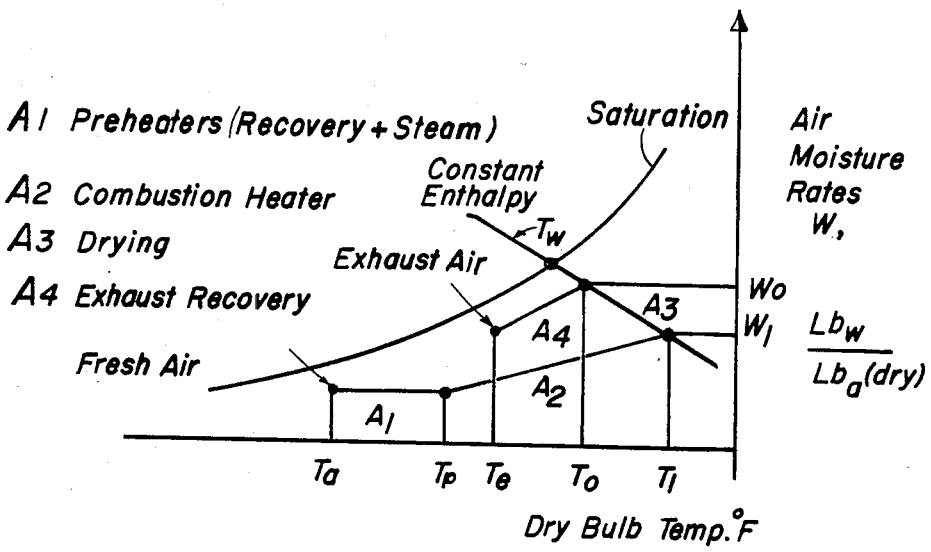
FIG. 3 – Adiabatic Drying Cycle
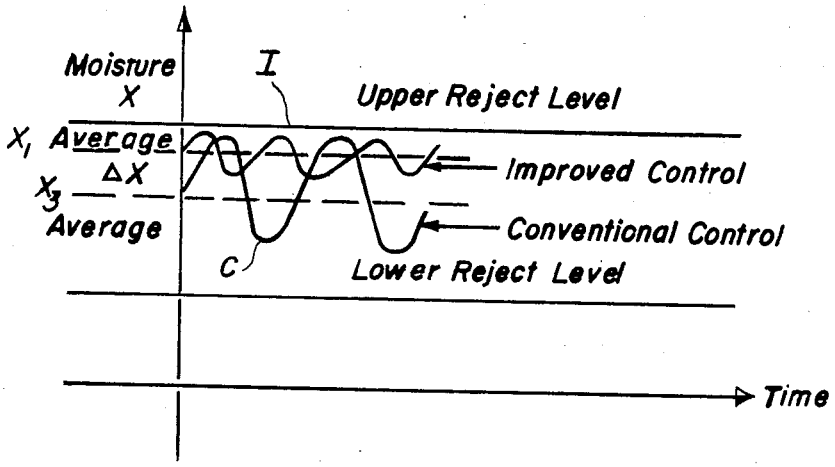
FIG. 8

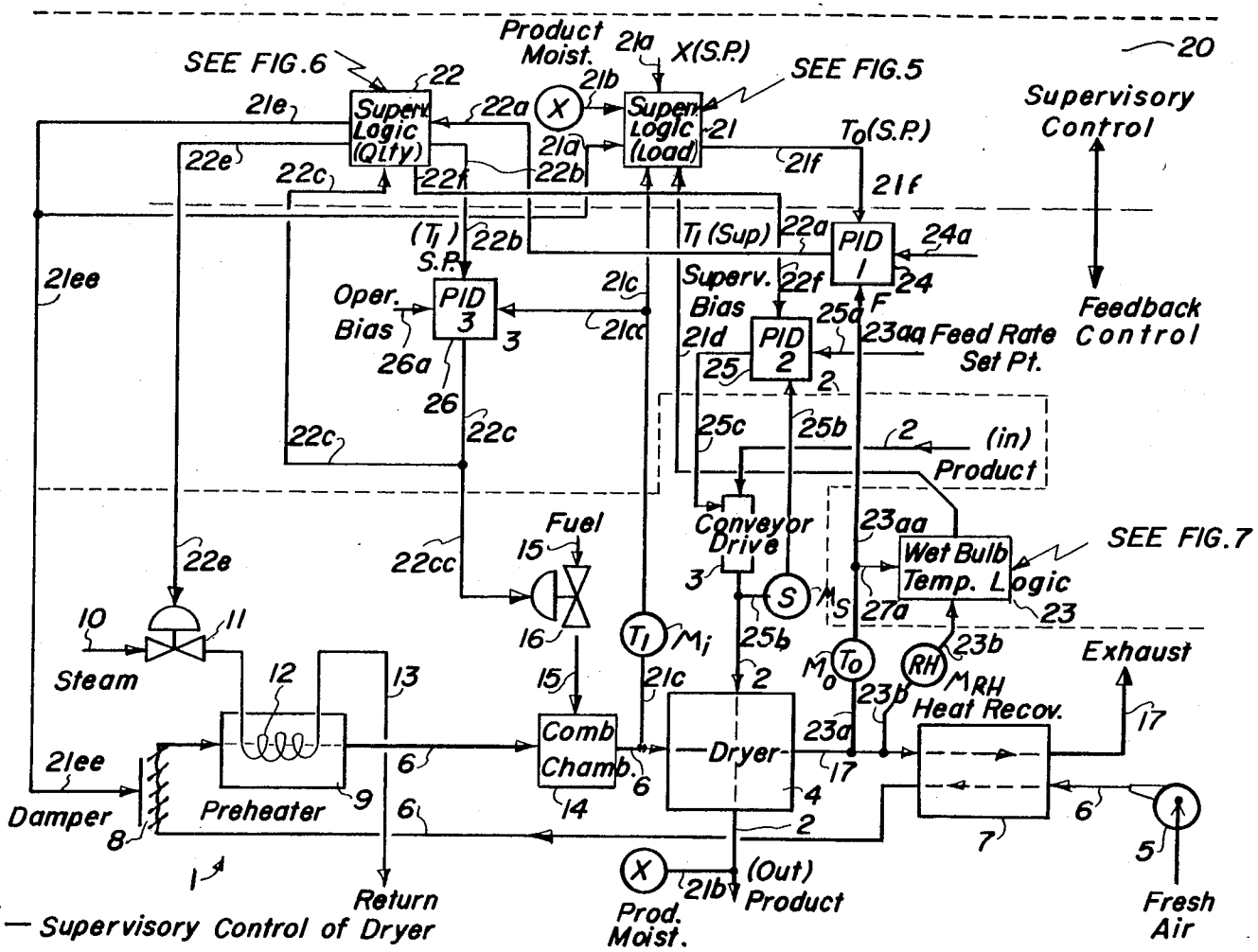
FIG. 4— Supervisory Control of Dryer

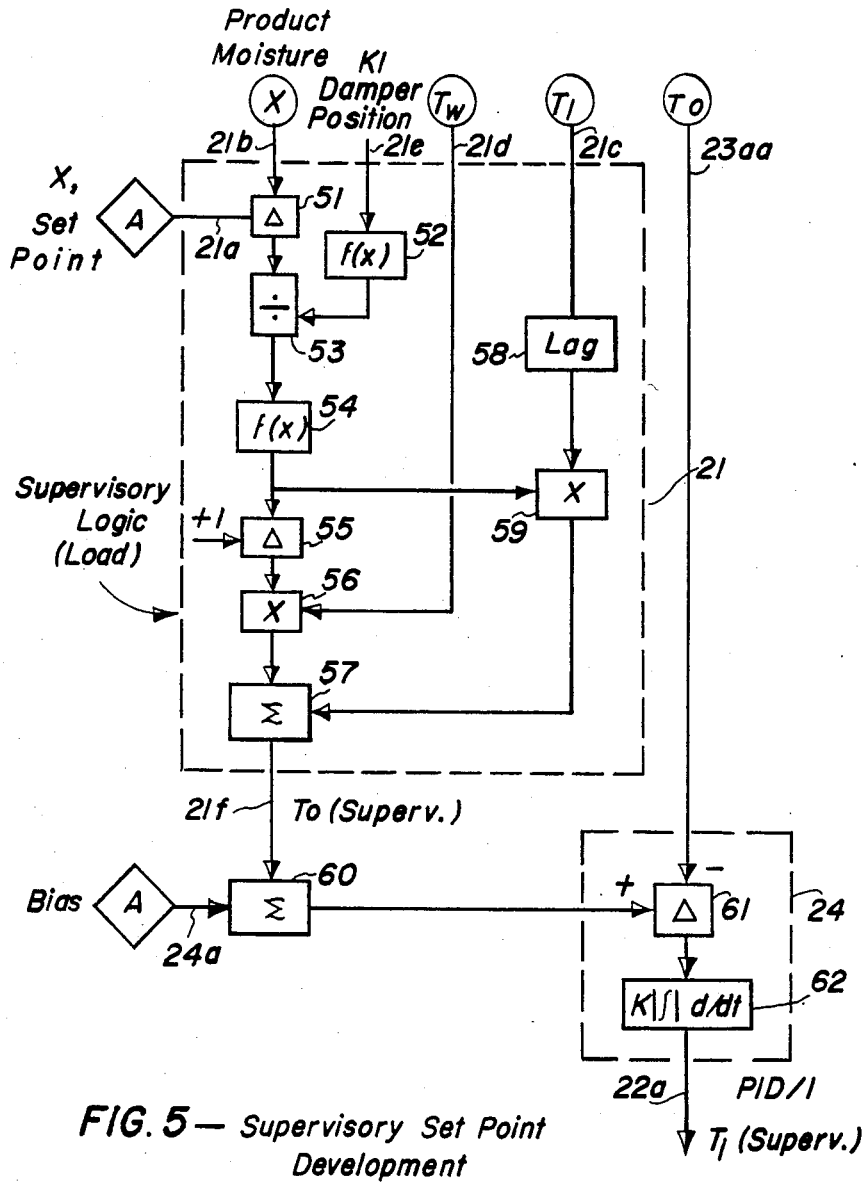
FIG. 5 — Supervisory Set Point Development

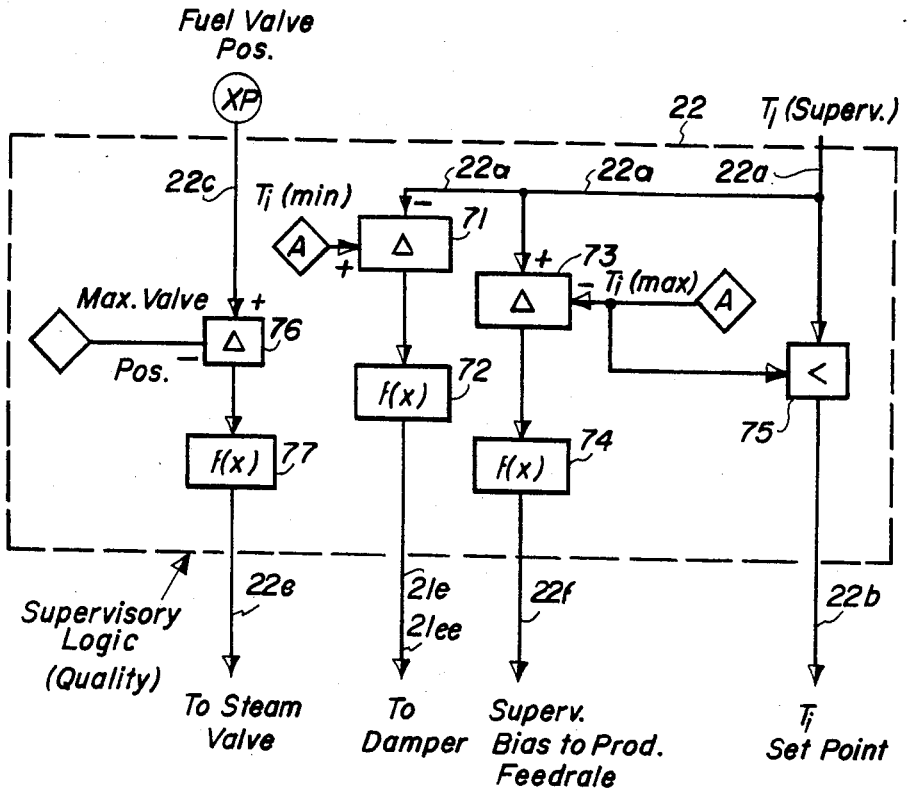
FIG. 6 — Supervisory Logic for Quality

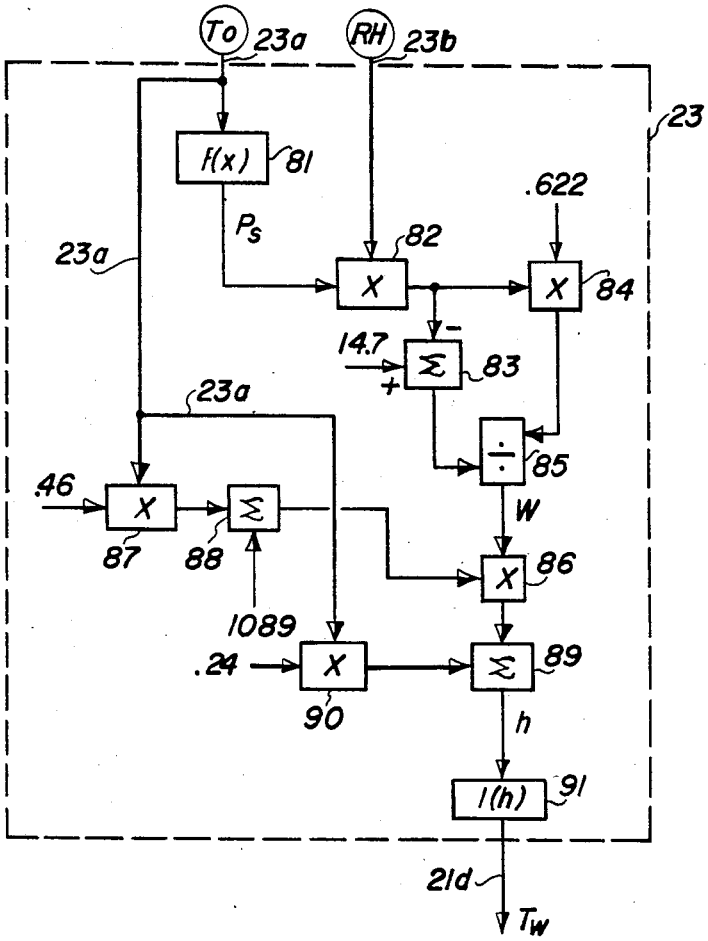
FIG. 7— Estimation of Wet Bulb Temperature

SUPERVISORY CONTROL SYSTEM FOR CONTINUOUS DRYING

BACKGROUND OF THE INVENTION

Field of the Invention

The present invention relates to a supervisory control system for continuous drying of moist solid products to reduce the moisture content thereof, and more particularly to the use of distributed process controls utilizing simple function blocks for tight control of the temperature and in turn of the residual level of moisture in the dried end product.

The drying process accounts for up to about 10% of all industrial energy usage. Control of industrial drying process operations has been less improved than is economically desirable or feasible, yet advanced control methods using distributed control systems might well be implemented therefore with a concomitant attractive return on investment.

Dryers are widely used in process industries such as pulp and paper, food, chemicals, building materials, metals, textiles, pharmaceuticals, ceramics and agriculture. The conventional types of dryers most commonly used are fluidized bed, kiln, rotary, conveyor, solar, batch, pan, spray, etc. dryers.

As in any processing operation, the goal of pertinent control strategies and methods of operating a continuous dryer is high profitability. This profitability can be improved potentially in terms of reduced energy costs, increased productivity and improved product quality.

Traditionally, the outlet dry bulb temperature $T_0$ of the drying agent (which is normally air) leaving the dryer is controlled, i.e. the process is monitored in terms of the measurement of the exhaust air temperature. Load variations are handled by modifying the inlet dry bulb temperature $T_i$ of the hot drying medium (air) entering the dryer. However this approach generally causes underdrying or overdrying, due to changing product load conditions, which degrades the dryer performance even though the temperatures are adequately controlled. Indeed, humidity must be controlled accurately to cope with the normally encountered variations in mass, flow and in moisture content of the starting product entering the dryer.

The main incentives for precise control of humidity in dryers in this regard are:

1. Reduced energy usage per unit weight product throughput.
2. Increased production rate for a given size dryer installation.
3. Increased profit from increased moisture sold as product where appropriate.
4. Reduced chance of fire.
5. Reduced production of defective products.
6. Reduced particle emission.

Generally, higher efficiency is obtained by observing such conditions as high temperature and low humidity which help increase the ability of the hot air to pick up moisture from the product during drying, and low exhaust volume or outlet air flow which represents a reduced energy and equipment cost. However, the necessary constraints of product quality, e.g. freedom from scorching, and excessive heat loss must be considered when the use of increased temperatures for the drying operation are proposed.

In the case of adiabatic continuous drying of wet solid products with a gaseous drying medium such as air, atmospheric pressure (14.7 psi), i.e. at generally constant pressure, in which the product moisture is evaporated from the product top surface, the product temperature remains generally constant throughout its travel e.g. on a conveyor through the dryer and is approximately the same as the wet bulb temperature $T_w$ of the drying medium . As the hot drying medium, which has a relatively low relative humidity RH and a relatively high inlet dry bulb temperature $T_i$ when it enters the dryer, takes on moisture from the wet product, the relative humidity of the medium increases and its temperature decreases. Thus, upon giving up heat to the moisture in the evaporation process, the drying medium is cooled to the relatively low outlet dry bulb temperature $T_0$.

However, ignoring normal heat losses the heat content (enthalpy) of the gaseous drying medium, e.g. air, is considered to be the same at the inlet and outlet ends of the gas flow path of the dryer since the heat given up by the drying medium is still contained in the taken up moisture. This can be theoretically measured by a wet bulb thermometer since we have constant heat the process will have a correspondingly constant wet bulb temperature $T_w$. On the other hand, the reduction in the dry bulb temperature of the drying medium from $T_i$ to $T_o$ is proportional to the amount of water which is evaporated from the product.

The temperature difference between the drying medium and the product at the dryer inlet increases with increasing load but such temperature difference decreases at the dryer outlet since the product temperature generally follows the constant wet bulb temperature $T_w$ whereas the drying medium decreases from the higher inlet dry bulb temperature $T_i$ to the lower outlet dry bulb temperature $T_0$ as it takes on moisture from the product under the adiabatic conditions. Hence, with an increase in product load underdrying is prone to occur and the end product may exceed the maximum moisture limit or product reject level set for the product. This is but one of the control problems encountered in drying operations.

Such temperature difference between the drying medium and the product constitutes the driving force $(T_i-T_w)$ at the inlet end and the driving force $(T_0-T_w)$ at the outlet end for driving (evaporating) moisture from the product.

Psychromatric charts are available which suitably show the drying temperature of the medium plotted against the weight of the water vapor or humidity removed in the drying process per unit weight of dry medium (air), giving related wet bulb temperature data as well, usually in terms of a given constant $T_w$ relative to the humidity increase between that at $T_i$ and that at $T_0$ under adiabatic (constant enthalpy) conditions at constant atmospheric pressure.

The prior art contains many proposals for effecting and controlling continuous drying operations such as the continuous drying of wet solids.

Thus, Threokelv, J. L., "Thermal Environmental Engineering", Chap. 18, 1962, Prentice-Hall, describes the dynamics of continuous drying of wet solids.

Fadum, O., and Shinsky, G., "Saving Energy Through Better Control of Continuous Batch Dryers", Control Engineers, March 1980, pp. 69–72, describes a control system for saving energy in which the exit gas (air) temperature is controlled by the control set point adjustment of the hot gas entering the dryer, involving a cascade loop. Based on dryer types and inferential measurement of the wet bulb temperature of the hot gases in turn the exit gas temperature setting is modified. A positive feedback instability is avoided by a low gain and by a lag network. The psychromatric properties of the air are taken into account. Linearization is performed to approximate the thermodynamic properties of the air. Constant air flow is considered for a simplified feedback control. Scorching of the product is avoided by limiting the dryer inlet temperature and controlling the feed rate of the product for a desired product moisture.

Zagorzycki, P. E., "Automatic Humidity Control of Dryers", Chemical Engineering Progress (C.E.P.), April, 1983, pp. 66–70, discusses a control system in which the dew point temperature of the exhaust gases (air) exiting from the dryer is measured to control the air flow damper at the exit. As dew point is an indication of moisture, the exhaust flow can dictate the dew point by controlling the supply of outside air, i.e. dry air into the dryer.

Bertin, R., and Srour, Z., "Search Methods Through Simulation for Parameter Optimization of Drying Process", Drying 1980, Vol. 2, pp. 101–106, Proceedings of the 2nd Intl. Symp. on Drying, July 6–9, 1980, Montreal, Hemisphere Publ. concerns a proposal in which the dryer is modeled and the operation optimized by using an extensive amount of computations. A continuous system is transformed into a discrete system by increasing the number of variables and performing integration by a predictor corrector method. Furthermore, weighted least squares estimates are utilized for model fitting. For optimization, steepest descent and similar methods are utilized. The methods utilized high level computer languages. The goal of this work is to provide optimum steady state operation for capacity production versus tray loading for optimum drying as regards product moisture.

Moden, P. E., and Nybrant, T. "Adaptive Control of Rotary Drum Driers", Digital Computer Applications to Process Control, Proceedings of the 6th I.F.A.C./I.F.I.P. Conf., 1980, pp. 355–361, discusses a system in which an adaptive control is implemented to control the moisture of the product in a rotary drum dryer. The method utilizes extensive computation with high level computer language. The control, although advanced, is restricted to feedback control of moisture.

Waller, M., and Curtis, S., "Energy Management for Drying Systems By a Computer-Based Decision Aid", Proceedings of the 2nd Into. Symp. on Drying, July 6–9, 1980, pp. 495–499, Montreal, Hemisphere Publ., concerns a system in which optimization with respect to energy is treated. However, this method also uses high level computer languages and deals with the steady state operation to guide the operators.

U.S. Pat. No. 4,471,027, issued Oct. 2, 1984, to Kaya, A. and Moss, W. H., concerns the optimum control of cooling tower water temperature by function blocks involving wet bulb temperature estimation.

Much room for improvement in profitability results exists in drying operations in terms of reduced energy costs, increased productivity and improved product quality, as compared to the results achievable with the above described known proposals.

SUMMARY OF THE INVENTION

It is an object of the present invention to overcome the deficiencies and drawbacks of the prior art and to provide a supervisory control system contemplating an arrangement and counterpart process for controlling the operation of a dryer for the continuous drying, especially adiabatic, drying of a moist solid product with a gaseous drying medium such as air for direct or close control of the dry product moisture.

It is another object of the present invention to provide such a system for controlling the operation of the dryer to achieve a minimum heating energy cost, a maximum product throughput and high efficiency in drying to a predetermined moisture content to within narrow limits, for a given dryer installation while preventing product scorching, overdrying and underdrying, so as to produce a high quality dried product, despite variations in the load conditions including variations in the mass and moisture content of the starting product entering the dryer.

Briefly, the supervisory control system of the present invention contemplates an arrangement and a counterpart process for controlling the operation of a dryer for the continuous, especially adiabatic drying of a moist solid product with a drying medium for direct or close control of the dried product moisture.

The system arrangement according to the present invention basically comprises temperature determining means for determining the wet bulb temperature of the gaseous drying medium such as air in the dryer from the measurements of the prevailing outlet dry bulb temperature and outlet relative humidity of the medium in the dryer plus supervisory adjustment means and supervisory control means.

The supervisory adjustment means contemplates means for determining from the measurements of the prevailing inlet dry bulb temperature and outlet dry bulb temperature of the medium in the dryer and from the determined wet bulb temperature a supervisory value corresponding to the energy supply rate of the heating energy supply such as combustion fuel needed for heating the medium to an optimum inlet dry bulb temperature operating value for drying the product to a predetermined moisture content within tight or minimum amplitude limits at a predetermined drying medium flow rate and:a predetermined product feed rate to the dryer.

The supervisory adjustment means also contemplates means for producing from the supervisory value in relation to said measurement of the outlet temperature a corresponding supervisory signal.

The supervisory control means contemplates energy supply control means for limiting the supervisory signal to a set point value which does not exceed a predetermined maximum supervisory value corresponding to a predetermined maximum energy supply rate for heating the medium to a predetermined maximum inlet dry bulb temperature operating value, and for producing from the set point value limited signal in relation to said measurement of the inlet temperature a corresponding energy control signal for controlling the energy supply for heating the medium to an optimum said inlet temperature operating value which does not exceed said predetermined maximum operating value, whereby to prevent product scorching.

The supervisory control means desirably also contemplates medium flow control signal producing means for producing a flow adjustment signal when the supervisory signal is below a predetermined minimum supervisory value corresponding to a predetermined efficient minimum energy supply rate for heating the medium to a predetermined minimum inlet dry bulb temperature operating value, and for producing from the flow adjustment signal a corresponding medium flow control signal for reducing the medium flow rate from said predetermined flow rate, such as by a damper, in proportion to the difference between the supervisory signal value and said predetermined minimum supervisory value, and means for feeding back the medium control signal to the supervisory adjustment means for adjusting the supervisory value independent upon the medium control signal and the thereby reduced medium flow rate, and for producing an adjusted supervisory signal relative to the adjusted supervisory value, whereby to prevent product overdrying.

The supervisory control means desirably further contemplates product feed rate control signal producing means for producing a feed adjustment signal when the supervisory signal exceeds said predetermined maximum supervisory value, and for producing from the feed adjustment signal a corresponding bias signal for reducing the product feed rate, such as by a conveyor belt drive control mechanism, in proportion to the difference between the supervisory signal value and said predetermined maximum supervisory value, whereby to prevent product underdrying.

The supervisory control means preferably additionally contemplates, when the energy control signal is arranged for controlling a basic supply of heating energy such as conbustion fuel, a supplemental heating energy control signal producing means for producing a supplemental supply adjustment signal when the energy control signal exceeds a predetermined maximum basic energy supply value corresponding to a predetermined maximum basic energy supply rate for the basic supply of heating energy, and for producing from the supplemental adjustment signal a corresponding supplemental supply control signal for supplying supplemental energy for heating the medium, such as drying medium, pre-heating, steam at a supplemental supply rate in proportion to the difference between the energy control signal value and the predetermined maximum basic energy value.

Favorably, the temperature determining means, supervisory adjustment means and supervisory control means each comprises function blocks in a logic arrangement.

According to the present invention basically comprises feeding the moist solid product to the dryer at a predetermined product rate supplying heating energy, such as combustion fuel, for heating the gaseous drying medium such as air, and flowing the heated gaseous drying medium which has been heated by the heating energy to the dryer at a predetermined drying medium flow rate in conjunction with the steps of measuring substantially continuously or automatically said prevailing inlet and outlet dry bulb temperagures.

The counterpart system process according to the present invention basically comprises feeding the moist solid product to the dryer at a predetermined product feed rate supplying heating energy such as combustion fuel, for heating the gaseous drying medium, such as air, and flowing the heated gaseous drying medium which has been heated by the heating energy to the dryer at a predetermined drying medium flow rate, in conjunction with the steps of measuring substantially continuously or automatically said prevailing inlet and outlet dry bulb temperatures and outlet relative humidity, determining substantially continuously or automatically said wet bulb temperature from said measurements of the outlet temperature and relative humidity, determining substantially continuously or automatically a supervisory value and producing substantially continuously or automatically a corresponding supervisory signal, and supervising substantially continuously or automatically the operation to prevent scorching, overdrying and underdrying of the product by controlling the supervisory signal.

The step of determining the supervisory value and producing the supervisory signal, contemplates determining from said measurements of the inlet and outlet temperatures and from the determined wet bulb temperature a supervisory signal which corresponds to the energy supply rate of the heating energy supply needed for heating the medium to an optimum inlet dry bulb temperature operating value for drying the product to a predetermined moisture content at said predetermined medium flow rate and said predetermined product feed rate and producing from the supervisory value in relation to said measurement of the outlet temperature the corresponding supervisory signal.

The step of supervising the operation by controlling the supervisory signal contemplates limiting the supervisory signal to a set point value which does not exceed said predetermined maximum supervisory value which corresponds to said predetermined maximum energy supply rate for heating the medium to said predetermined maximum inlet temperature operating value, and producing from the set point value limited signal in relation to said measurement of the inlet temperature a corresponding energy control signal for controlling the energy supply for heating the medium to an optimum inlet dry bulb temperature operating value which does not exceed said predetermined maximum operating value, whereby to prevent product scorching.

The step of supervising the operation also contemplates producing a flow adjustment signal when the supervisory value is below said predetermined minimum supervisory value which corresponds to said predetermined efficient minimum energy supply rate for heating the medium to said predetermined minimum inlet temperature operating value, producing from the flow adjustment signal a corresponding medium flow control signal for reducing the medium flow rate from said predetermined flow rate in proportion to said difference between the supervisory signal value and said predetermined minimum supervisory value, and feeding back the medium control signal to the step of determining the supervisory value and producing the supervisory signal, for adjusting the supervisory value independent upon the medium control signal and the thereby reduced flow rate, and for producing an adjusted supervisory signal relative to the adjusted supervisory value, whereby to prevent product overdrying.

The step of supervising the operation further contemplates producing a feed adjustment signal when the supervisory signal exceeds said predetermined maximum supervisory value, and producing from the feed adjustment signal a corresponding bias signal for reducing the product feed rate in proportion to the difference between the supervisory signal value and said predetermined maximum supervisory value whereby to prevent product underdrying.

The step of supervising the operation preferably additionally contemplates when the energy control signal is used to control a basic supply of heating energy, such as combustion fuel, producing a supplemental supply adjustment signal when the energy control signal exceeds a predetermined maximum basic energy value which corresponds to said predetermined maximum basic energy supply rate for the basic supply of heating energy and producing from the supplemental adjustment signal a corresponding supplemental supply control signal for supplying supplemental energy, such as air, pre-heating steam for heating the medium at a supplemental supply rate in proportion to the difference between the energy control signal value and said predetermined maximum basic energy value.

Favorably, the steps of determining the wet bulb temperature, determining the supervisory value and producing the supervisory signal, limiting the supervisory signal and producing the energy control signal, producing the flow adjustment signal and the medium flow control signal, producing the feed adjustment signal and the bias signal, and producing the supplemental supply adjustment signal and the supplemental supply control signal, are correspondingly carried out substantially, automatically using function blocks in a logic arrangement.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings

FIG. 1 shows a typical drying curve for an adiabatic continuous drying operation for drying a wet solid product, indicating the rate of moisture loss with time from the top surface of the product;

FIG. 2 shows a related curve to that of FIG. 1 indicating the changes in drying rate as the product moisture is given up first from the surface and then progressively from the interior of the product;

FIG. 3 shows a psychrometric chart with curve data for an adiabatic drying cycle according to the present invention, indicating the relation between the air moisture content and the dry bulb temperature at various points in the drying operation at constant enthalpy, plus related wet bulb temperature conditions;

FIG. 4 is a schematic view of a system arrangement for supervisory control of a dryer according to an embodiment of the present invention, utilizing the drying cycle of FIG. 3;

FIG. 5 is a schematic view of function blocks in a logic arrangement for supervisory set point development of an optimum inlet dry bulb temperature operating value $T_i$ (Superv.), as used in the arrangement of FIG. 4;

FIG. 6 is a schematic view of function blocks in a logic arrangement for supervisory logic control for quality performance to prevent scorching, overdrying and underdrying, as used in the arrangment of FIG. 4;

FIG. 7 is a schematic view of function blocks in a logic arrangement for accurate estimation of the wet bulb temperature $T_w$, and;

FIG. 8 is a graph showing the improved control of the product moisture within narrow limits with time using the arrangement of FIG. 4, as compared to the conventional operation.

DETAILED DESCRIPTION OF THE PREFERRED EMBODIMENTS

By way of background orientation, as to the dynamics of a continuous dryer such as one in which the product is conveyed by a drive conveyor through the drying chamber of the dryer, the drying process may be regarded as operating under the following assumptions:

1. A wet solid product is being dried which contains both bound and unbound moisture.
2. The top surface alone of the product is exposed to the drying medium, e.g. air.
3. No other external heat source than the drying medium exists.
4. The drying medium has a fixed or constant temperature, humidity and velocity or flow rate.

In line with such assumptions, FIG. 1 illustrates the basic drying process concept in which the reduction in the product moisture content X of a wet solid varies with time at different rates. The product moisture content X is defined as the solid moisture ratio by weight of the water to be dry solid product in LBS of water per LB dry solid, i.e. moisture $X=LB_w/LB_s$.

Initially, i.e. once steady state conditions are achieved, as shown in FIG. 1 water is evaporated at a relatively fast constant rate as product moisture X decreases with time, hr, along the straight line ratio span of period B between points 1 and 2 of the curve since the product is completely wet and drying occurs due to the removal of surface moisture in a manner independent of product moisture.

However, during the remainder of the drying time, the drying rate decreases in a falling rate region, first at an intermediate rate in period C between points 2 and 3, and then at a slow rate in period D between points 3 and e, e signifying the equilibrium exit point of the product from the dryer and having a final equilibrium condition product moisture content of $X_e$.

This is explained by the fact that in the falling rate region the product has dry spots and the evaporation occurs from inside the solid material. Specifically the drying rate progressively falls as the evaporation from within the product takes place first from the adjacent or shallow interior (period C) and then from the remote or deep interior (period D) once the removal of surface moisture has been completed (period B).

In FIG. 2 the corresponding drying periods of FIG. 1 are shown in terms of the drying rate R of water evaporated per unit time, hr, and product surface area i.e. $R=LBS_w/hr\text{-}ft^2$, plotted against the moisture content X. Once unsteady state conditions (period A) are overcome, the rate R is constant for the moisture reduction from quantity $X_1$ to $X_2$ between points 1 and 2, in period B, and thus the corresponding rates $R_1$ and $R_2$ are equal.

The first falling rate subregion, between points 2 and 3 in period C, shows a rate decline from $R_2$ to $R_3$ corresponding to the moisture reduction from quantity $X_2$ to $X_3$, with an intermediate proportional point corresponding to rate $R_c$ at moisture content $X_c$ in the straight line ratio slope of the curve for period C. The following or final falling rate subregion, between points 3 and e, in period D, shows an even slower rate from the $R_3$ point to the $R_0$ or zero rate point corresponding to the moisture reduction from quantity $X_3$ to final moisture content $X_e$, with an intermediate proportional point corresponding to rate $R_D$ at moisture content $X_D$ in the straight line ratio slope of the period D.

Threokeld (supre) describes the rate of drying (i.e. a negative quantity for moisture loss or rate of decrease in product moisture) as:

$$R=(-1/Hs)dx/dt \quad \text{(I)}$$

Where R is the drying rate of the wet solid in $LBS_w$/hr-ft$^2$, $A_s$ is the surface of the solid in ft$^2$/$LB_s$(dry solid), S is the moisture content of the wet solid in $LB_w/LB_s$, and t is the time in hr.

Considering the significant decremental or die-away product moisture period D, as shown in FIG. 2, R may be written as:

$$R_D=(X_D-E_e)R_3/X_3-Xe \quad \text{(II).}$$

Assuming $X_e=0$ at final product moisture content of the end product exiting from the dryer, the relation for variations from $X_e$ may be written as:

$$R_R=X_DR_3/X_3 \quad \text{(III).}$$

If the ratio $R_3/X_3$ is assigned the decrement constant value K and $R_D$ and $X_D$ are designated R and X, Eq. (I) becomes $XK=(-1/A_s)$dx/dt or:

$$dx/X=-KA_sdt \quad \text{(IV)}$$

and per the die-away factor $e^{-KA_s}$ in which e is the base of naturao water rhythms, considering that the rate of decrease in product moisture X is proportional to the magnitude C of the moisture content X which is decreasing (FIG. 1) from the end of period C at $X_3$(beginning of period D where C is the starting moisture content and time t=zero) to the end of period D at $X_e$ (FIG. 3), in turn leads to:

$$X=C_e^{-KA_t}$$

or $$C_e^{-1\tau/t} \quad \text{(V)}$$

In which as the reciprical of the decrement constant quantity the time constant:

$$\tau=1/KA_s$$

or $$X_3R_3A_s, \text{ hr} \quad \text{(VI)}$$

In this regard, Eqs (I) and (V) indicates that this process is a first order process (in which the drying rate is directly proportional to the product moisture) with a time constant.

Eq. (I) can be made more specific for enthalpy flow or heat flux and for solid thickness. Thus, R and $A_s$ can be correspondingly written as:

$$R=(1/\lambda)H_c(T_i-T_w);\ A_s=1/d_s1$$

Where λ is the heat of vaporization at $T_w$,Btu/$lb_w$,$h_c$ is the surface heat transfer co-efficient, Btu/hr-ft$^2$-°F., $T_iT_w$ are the dry and wet bulb temperatures respectively, of the inlet or entering air, °F., $d_s$ is the bulk density of the dry solid product, $LB_s$/FT$^3$, and 1 is the thickness of the solid (bed), FT.

Substituting this relation in Eq. (I) leads to:

$$(-\lambda/A_s)dx/dt=h_c(T_i-T_w) \quad \text{(IX)}$$

It should be noted that for a fixed λ and $A_s$ the following relation holds:

$$d(-\lambda X)/vdA_s=hc(T_{i-Tw}) \quad \text{(X)}$$

The left side of Eq. (IX) gives the heat flux (enthalpy transfer to the solid) causing the moisture removal, while the right side of Eq. (IX) is the driving force (input).

From Eq. (IX) it is clear that the moisture content X of the solid can be controlled by $T_i$, where the parameters $A_s$ and $T_w$ are regarded as disturbances of the product load and for the moisture content (relative humidity) of the inlet or entering air respectively. For adiabatic drying at constant pressure, the temperature of the wet solid product surface is considered the same as the wet bulb temperature $T_w$ of the inlet air. As product load increases, the relation dx/dt decreases. For a cessified X value at the exit of the dryer, the value of (Thd i-$T_w$), i.e. the temperature difference between the inlet air and the inlet product, or the inlet driving force, must increase to control X at a specified value. Furthermore, as the moisture of the entering air to the dryer increases, $T_w$ increases as well. This change again affects the X value.

This all implies that controlling the temperature $T_0$ of the outlet or exiting air does not provide or assure the desired moisture content X in the product leaving the dryer. The fact is that either underdrying or overdrying of the product generally occurs. Studies indicate (Fadum et al supre) that the use of mass and heat balance relationships with a given dryer structure can be used to prove that the product moisture X may be written, for the above described falling drying rate region, in natural logarithm terms as:

$$X=K_1ln(T_i\text{-}T_w)/(T_0\text{-}T_w) \quad \text{(XI)}$$

Where $T_0$ is the exit temperature of the outlet air from the dryer, °F., $P_1$ is a constant for the particular dryer and operation, $T_i$ and $T_w$ are the dry and wet bulb temperatures respectively of the inlet air entering the dryer, °F., and $T_0$ is the exit temperature of the outlet air from the dryer, °F.

Eq. (XI) implies that in order to maintain constant the moisture content X of the product, the ratio ($T_i$-$T_w$)/($T_0$-$T_w$), i.e. the ratio of the inlet driving force to the outlet driving force should be kept constant. It will be seen that the same observation can be made as regards Eq. (IX).

If the comparatively low outlet temperature $T_0$ is to be controlled at a constant value, the increased load would require an increase in the comparatively high inlet temperature $T_i$ which would result in an increase in the numerator and a decrease in the denominator, causing the value of X to increase.

It will be seen from Eq. (XI) that the product moisture X can be determined by measuring temperature values, not moisture, and that such is independent of such variables as product feed rate, air flow as well as feed moisture. However, the measurement of the wet bulb temperature $T_w$ is used to measure the relative humidity of the air.

The pertinent relationships have been developed for finding $T_w$ from relative humidity measurements (See Kaya, A., "Modeling of an Environmental Space for Optimum Control of Energy Use", Proceedings of VIIth Intl. Federation of Automatic Control (IFAC) World Congress, Helsinki, Finland, Amer. Soc. of Heating Refrigerating and Air Conditioning Engineers (ASHRAE) Transactions, Vol. 88, Pt. 2, No. 2714, 1982).

Nevertheless, the measurement of $T_w$ is not always an easy task.

In this regard, referring to the gases (air) leaving the dryer and having a dry bulb temperature $T_0$ and wet bulb temperature $T_w$, the estimation of $T_w$ may be carried out as follows.

Assuming the relative humidity RH of the outlet or exiting air is $\phi$ and the dry bulb temperature thereof is $T_0$, the air moisture ratio W, which may be defined as the ratio by weight of the water to dry air in LBS of water per LB dry air (gas) i.e. moisture ratio $W=LB_w/LB_g$, maybe found by using the relations of the pertinent psychrometric chart and where W has the significance:

$$W=0.622\phi\alpha e^{\beta T_0}/14.7-\phi e^{\beta T_0},\ LB_w/LB_g \qquad \text{(XII)}$$

Where $\phi$ is the relative humidity, %, $\alpha$ and $\beta$ are constants, e is the base of natural logarithms and $T_0$ is the exit temperature of the outlet air from the dryer, °F.

Hence, upon ascertaining W and measuring $T_0$ for the outlet or exiting air from the dryer, the wet bulb temperature $T_w$ can be found (See U.S. Pat. No. 4,474,027 to Kaya et al, supra).

These items are used in accordance with the supervisory control system of the present invention for carrying out continuous, especially adiabatic, drying of wet solid products under tight control conditions. Briefly, by measuring $T_0$ and the relative humidity $\phi$, W can be found per Eq. (XII), and upon applying an enthalpy h calculation in known manner $T_w$ can be found. Applying $T_w$ in Eq. (XI), for a given $K_1$ and $T_0$, any changes in measured $T_i$ will signify an imbalance in X compared to a desired predetermined final product moisture content, prompting an adjustment in the operating conditions such as the heating energy supply rate.

FIG. 4 shows an arrangement of a continuous dryer installation 1 having a control system 20 according to the present invention, contemplating the utilization of Eqs. (XI) and (XII) for supervisory control of the drying process, and which may be operated in accordance with the self-evident adiabatic drying cycle relationships of moisture containing air and temperature as shown in FIG. 3.

A wet solid starting product having a relatively high initial moisture content is fed at a predetermined product feed rate, e.g. LBS/hr by a product feed line 2 such as a controlled speed conveyor belt having a controlled drive 3, through the drying medium operated dryer 4 for reducing the moisture content of the product to a selective predetermined moisture level corresponding to the desired end product moisture ratio or moisture content X by weight of the water to the dry solid product e.g. LBS water/LB dry solid.

Hence, the product is recovered from the dryer 4 as a relatively low final moisture content dry solid end product for appropriate end point use or sale.

Product moisture X may be readily conveniently determined by an X measuring device in control line **21*b* of control system 20** in those cases where appropriate, but such is not normally contemplated as is here and after pointed out.

To accomplish the drying of the solid product, a blower 5 is used to feed a gaseous drying medium such as air via an air feed path or inlet line 6 respectively through a heat recovery chamber or economizer 7 such as a heat exchanger for preliminary air pre-heating, a controlled damper 8 containing flow arrangement and a preheater 9.

A source of supplemental heat energy such as steam is optionally fed by a heat line 10 at a given feed rate under the control of the controlled valve 11 through the heating coils 12 located in preheater 9 for predominant preheating of the air passing therethrough.

The so preheated air continues via line 6 from preheater 9 to the main heater or combustion chamber 14 which is heated by feeding a supply of heat energy thereto such as combustion fuel, through main heat energy line 15 at a given feed rate under the control of the controlled fuel valve 16.

The so heated air from the heater 14 is then fed by a line 6 to the dryer 4 at a given input flow rate or feed rate under the control of the damper 8 for drying the moist product by taking up moisture therefrom and forming moisture laden air which is exhausted from the dryer 4 via an air exhaust path or outlet line 17.

The exhaust air is fed to the heat recovery chamber 7 where it gives up sensible heat values to the incoming air in line 6 for partially preheating the fresh inlet air.

A $T_i$ measuring device $M_i$ in control line **21*c* is positioned in operative connection with air line 6 for measuring the dry bulb temperature, e.g. °F., of the heated inlet air from the heater 14 at a point in line 6 just as it enters the dryer 4. A $T_0$ measuring device $M_0$ in control line 23*a* and an RH measuring device $M_{RH}$ in control line 23*b* are individually positioned in operative connection with exhaust path 17 for respectively measuring the outlet dry bulb temperature (°F.) and relative humidity RH of the moisture laden exhaust outlet air recovered from the dryer 4**.

A conveyor speed measuring device $M_s$ in control line **25*b* is positioned in operative connection with the conveyor 3** for measuring the conveyor speed S.

These $T_i$, $T_0$ and RH measuring devices or sensors for measuring the corresponding physical properties of the air, and the conveyor speed S measuring device for measuring the product feed rate or throughput, are operatively connected via their individual input signal control lines **21*c*, 21*a* and 21*b*, and 25*b*, respectively with the control system 20** for supervisory control of the drying process.

Control system 20 includes a supervisory logic load block or module 21 for supervisory product moisture set point development (FIG. 5), a supervisory logic quality block or module 22 for supervisory product quality, e.g. to prevent product scorching, overdrying and underdrying (FIG. 6), and a wet bulb temperature logic block or module 23 for estimation or determination of the wet bulb temperature $T_w$ of the heated air from the heater 14 at a point in line 6 just as it enters the dryer 4 (FIG. 7), along with conventional PID block controllers 24, 25 and 26.

These components of control system 20 are advantageously arranged in two phases including a supervisory control phase containing load block 21 and quality block 22 and a feedback control phase containing wet block 23 and the PID controllers 24, 25 and 26.

PID controls are used for generating output signals proportional to any difference or error measured (P), proportional to the integral of such difference (I), and proportional to the derivative or rate of such difference (D), as the case may be, i.e. PID. Thus, in a PID block, for example, a predetermined bias signal is applied to an input reference or supervisory set point control signal and the output set point bias value signal thereby produced is applied to or compared with a measured value feedback signal to provide or pass an output supervisory control signal for the PID block based on the set point bias value signal and/or the feedback signal.

As earlier noted, conventionally in a dryer installation such as that shown in FIG. 4, the outlet air temperature $T_o$ is controlled by fuel flow regulation and more precisely by the inlet air temperature $T_i$. However, the normally encountered variations in entering air and product moisture coupled with product flow variations cause fluctuations in the moisture content of the dried end product exiting from the dryer, even when the temperatures are reasonably maintained. This is due to the required change in the aforesaid driving force ($T_i$-$T_w$) rather than just $T_i$. By way of the control system 20 of the present invention, the normally attendent disadvantages of underdrying and overdrying of the product traceable to the above problems in conventionally operated dryers, are prevented along with product scorching prevention, by reason of the tight control of the product moisture X permitted herein (See FIG. 8).

Preliminarily, under the adiabatic drying cycle conditions in the psychrometric chart shown in FIG. 3 and assuming the heat energy supplied to the heater 14 is combustion fuel which under the firing conditions produces a given additional amount of moisture, the fresh air supplied by the blower 5 at the relatively cold dry bulb temperature $T_a$ is increased in temperature by an amount $A_1$ in the pre-heaters, (recover chamber 7 and steam pre-heater 9) to the relatively warm dry bulb temperature $T_p$ while its moisture content remains constant. The air temperature is further increased by an amount $A_2$ to the relatively hot dry bulb temperature $T_i$ in the combustion heater 14 while the moisture content is increased by a given amount due to the addition of combustion moisture, such that the hot air entering the dryer 4 as the relatively high inlet dry bulb temperature $T_i$ and the relatively low inlet moisture content $W_i$.

On the other hand, upon travel through the dryer 4, the temperature of the air is decreased by an amount $A_3$ to the relatively low outlet dry bulb temperature $T_0$ while its moisture content is increased to the relatively high outlet moisture content $W_0$. Upon passage through the exhaust recovery stage (recovery chamber 7) the temperature of the air is further decreased by an amount $A_4$ to the relatively cooler dry bulb exit temperature $T_e$ while its moisture content at that exit point is correspondingly decreased by a given amount roughly to about the inlet moisture content $W_i$.

The relationship at constant enthalpy of the corresponding wet bulb temperature $T_w$ to the $T_i$, $W_i$ and $T_0$, $W_0$ values controllable herein may be readily seen from the psychrometric chart of FIG. 3.

In effect, under adiabatic drying conditions per FIG. 3, the heat content (enthalpy) of the product and of the air remain constant, while the air temperature decreases from the higher inlet $T_i$ to the lower outlet $T_0$ temperature as it gives up heat to the evaporating moisture and increases its moisture content, such that the wet bulb temperature $T_w$ which is related to the enthalpy remains constant throughout the dryer as well. Hence, the determined wet bulb temperature $T_w$ per logic block 23 (FIG. 7) will apply to the inlet air in input path 6 even though the wet bulb temperature determination is based on the prevailing outlet air temperature and relative humidity measurements of the air in output or exhaust path 17.

In essence, the line 21*a* fed pre-set final product moisture content X value signal, the line 21*e* fed pre-set maximum efficiency air flow rate dependent damper position $K_1$ value signal, and the line 25*a* fed pre-set maximum efficiency product feed rate value signal, are processed with the line 21*c* and 21*d* fed prevailing $T_i$ and $T_w$ measurement value signals per Eq. (XI) to produce a corresponding $T_0$ supervisory value signal in load block 21 which is then processed with the line 24*a* fed bias signal to provide the corresponding $T_0$ set point value signal, and the latter is thereafter processed with the line 23*a* and 23*aa* fed prevailing $T_0$ measured value signal in PID-1 block 24 to produce a $T_i$ supervisory value signal.

The $T_0$ supervisory value signal corresponds to the $T_i$ supervisory value signal that represents the fuel supply rate needed for maintaining the air at an optimum inlet air dry bulb temperature operating value for the pre-set or predetermined corresponding product feed and air flow rate to yield the preset X value in the end product, based upon the then prevailing $T_0$ and RH measured and $T_w$ determined values.

In operation, per their respective censor and transmitter elements, each of the measuring devices $M_i$, $M_0$, $M_{RH}$ and $M_s$, produces a primary transmission signal as measurement value input in the corresponding feedback lines 21*c* and 21*cc* for the prevailing inlet temperature $T_i$ 23*a* and 23*aa* for the prevailing outlet temperature $T_0$, 23*b* for the prevailing outlet relative humidity RH, and 25*b* for the prevailing product feed rate determining conveyor speed S.

As a result of the supervisory control action of the closed loop or feedback loop comprised of the fixed function blocks in logic arrangment in the supervisory control system 20, control signals are ultimately produced, as the case may be, as corresponding outputs in lines 22*c* and 22*cc* for adjusting the fuel valve 16 and steam valve 11 in lines 21*e* and 21*ee*' for air flow rate return signal control action and for adjusting the air flow damper 8 respectively, and in lines 21*f* and 25*c* for adjusting the product feed rate determining conveyor drive 3.

Initially, utilizing Eq. (XII) and related enthalpy considerations for accurate estimation or determination of the corresponding air wet bulb temperature $T_w$ in logic block 23 (FIG. 7), the signal of the prevailing measured value of the outlet dry bulb temperature $T_0$ of the outlet air in exhaust path 17 is fed by a line 23*a* as input to the pressure function generator block 31. The block 81 output $P_s$ in the form of the function $\alpha e^{\Delta T0}$ representing the saturation vapor pressure at the measured $T_0$ temperature, is fed as input to muliplication function block 82.

The other input which is fed via line 23*b* to block 82 is the signal of the prevailing measured value of the outlet relative humidity RH of that exhaust air. The block 82 product output is in the form of the function $\phi\alpha e^{\beta T0}$ in which $\phi$ corresponds to RH.

The block 82 output is separately fed as input to multiplication function block 84 and also as negative input to subtraction or summation function block 83.

The other input to block 84 is the fixed value factor 0.622, and the block 84 product output in the form of the function $0.622\phi\alpha e^{\beta T_0}$ is fed as numerator to the division function block 85.

The other input to the block 83 is the fixed plus value atmospheric pressure factor 14.7 and the block 83 output in the form of the difference or summation function $14.7 - \phi\alpha e^{\beta T_0}$ is fed as denominator to block 85.

The block 85 quotient output thereby provides a signal corresponding to the air moisture ratio W which is fed as input to the multiplication function block 86.

The prevailing measured value $T_0$ signal is also separately fed by a line 23*a* as input to multiplication function block 87 and as input to multiplication function block 90 respectively.

The other input to block 87 is the fixed value factor 0.46, and the block 87 product output in the form of the function $0.46T_0$ is fed to the summation function block 88 whose other input is the fixed value factor 1089. The block 88 output in the form of the summation function $1089+0.46T_0$ is fed as the other input to block 86 with W from block 85 thereby producing the function $W(1089+0.46T_0)$ as block 86 output.

The other input to block 90 is the fixed factor value 0.24, and the block 90 product output in the form of the function $0.24T_0$ is fed as input to the summation function block 89, whose other input is the block 86 output.

The block 89 output represents the enthalpy value h which is equal to $0.24\ T_0+W(1089+0.46T_0)$. This h enthalpy value is then processed in enthalpy function generator block 91 to produce as output a $T_w$ signal in line 21*d* which represents the accurate estimation or determination of the corresponding prevailing air wet bulb temperature $T_w$ as derived from the prevailing measured values of the outlet air dry bulb temperature $T_0$ and relative humidity RH per Eq. (XII) and related enthalpy considerations according to well known procedures.

In turn, utilizing Eq. (XI) for supervisory set point development in load block 21 (FIG. 5) of the fuel supply rate for heating the air to achieve an optimum inlet air dry bulb temperature $T_i$ operating value in air feed path 6, the signal of the prevailing measured value of the inlet dry bulb temperature $T_i$ of the inlet air in feed path 6 is fed via line 21*c* as input to lag function block 58 while the so-determined $T_w$ signal from logic block 23 (FIG. 7) is fed via line 21*d* to multiplication function block 56. Also fed to logic block 21 is the return signal in line 21*e* from logic block 22 (FIG. 6).

Preliminarily, a predetermined product moisture X set point value for the predetermined desired optimum level of the final moisture content in the desired product recovered from the dryer 4 is fed as a reference input or standard signal (constant) via line 21*a* to comparison or summation function block 51. As earlier noted, should the operation lend itself to actual ongoing measurement and direct feedback control of the final product moisture of the recovered dried product, e.g. where load variations are slow and such measurement is feasible, the corresponding measurement value feedback signal for X can be fed via line 21*b* from the dryer output end of the product feed line 2 (FIG. 4) to block 51 for comparison with the moisture set point signal and appropriate signal shortcut processing.

In any case, the block 51 output desired product moisture signal is fed as numerator input to the division function block 53. The return signal in line 21*e* from logic block 22 (FIG. 6), which represents the value of the $K_1$ factor which indicates the position of the damper 8 and thus the level of the air flow rate relative to a predetermined desired optimum air flow rate for the particular dryer is fed as input to the function generator block 52. The block 52 output is fed as denominator input to block 53. The block 53 quotient output of the moisture and damper derived inputs in the form of the function $1/K_1f(x)$ is fed to the function generator block 54 to produce the function $F_1f(x)$ as output.

The block 54 output is fed to the multiplication function block 59 whose other input is the lag output of the prevailing measured value $T_i$ signal from line 21*c* which has been processed in lag function block 58 to avoid positive feedback problems as the artisan will appreciate. The block 59 product output in the form of the function $K_1f(x)T_i$ is fed as input to the summation function block 57

The block 54 output is also separately fed as negative input to the subtraction or summation function block 55, whose other input is the fixed plus value factor 1, thereby producing the output function $1\text{-}K_1f(x)$ which is fed as input to the multiplication function block 56. The other input to block 56 is the determined $T_w$ signal from block 23 (FIG. 7) fed via line 21*d*. The block 56 product output is in the form of the function $[1\text{-}K_1f(x)]T_w$ which is fed as the other input to summation function block 57.

The block 57 output in $T_0$(SUPERV.) line 21*f* is in the form of the addition function $K_1f(x)T_i+[1K_1f(x)]T_w$ which equals $T_0$ supervisory value per Eq. (XI).

Specifically, based on the fixed set point value input, the line 21*e* returns signal $K_1$ input the line 21*c*$T_i$ measured value input, and the line 21*d*$T_w$ determined value input, logic block 21 is used to solve for $T_0$ per Eq. (IX) in terms of the following:

$$1/A_1f(x)=(T_i\text{-}T_w)/(T_0\text{-}T_w)$$

and in turn:

$$K_1f(x)(T_i\text{-}T_w)=T_0\text{-}T_w$$

which leads to:

$$K_1f(x)T_i+[1\text{-}K_1f(x)]T_w=T_0$$

Providing an appropriate $T_0$ set point bias input via line 24*a* to summation function block 60, along with the Eq. (XI) solved $T_0$ supervisory value output signal $T_0$(SUPERV.) from block 57 in line 21*f* as the other input, based on the predetermined X set point value of the desired moisture content in the dried end product, a set point for $T_0$ is produced in logic block 21 in conjunction with the processing of the $T_0$ measured value feedback input via line 23*aa*.

Thus, the block 60 biased $T_0$(SUPERV.) signal output, representing the desired $T_0$ operating value for the corresponding optimum $T_i$ operating value, is fed as a positive set point input to the subtraction function block 61 of PID-1 block 24, whose other input is the $T_0$ measured value as feedback signal.

The block 61 serves as summing point and its output is fed to the proportional integral derivative function block 62 whose output in line 22*a* is the desired optimum $T_i$ operating value signal $T_i$(SUPERV.) which is proportional to a linear combination of the input, the time integral (or reset) of input and the time derivative (or rate of change) of input per the relation $K/\int/d/dt$, per conventional processing.

Finally, the optimum $T_i$ operating values signal $T_i$ (SUPERV.) as resultant supervisory signal is processed in quality block 22 (FIG. 6) to meet various constraints to assure that the dried product recovered from the dryer 4 will not be scorched, overdried or underdried but instead will possess a desired final moisture content X within relatively narrow limits of upper and lower moisture reject levels (FIG. 8) at the predetermined set point X value for a maximum optimum determined product feed rate at an optimum predetermined air flow rate in relation to the $K_1$ value, using a minimum optimum fuel supply rate or combined fuel and supplemental preheating steam supply rate.

The supervisory signal $T_i$(SUPERV.) in line 22*a* is fed as a feedback signal to the comparison function block 75 whose other input is the predetermined scorch preventing maximum temperature set point value signal $T_i$ (MAX) which represents a reference input or standard signal (constant) for high limiting control action to assure that the supervisory signal never exceeds the predetermined scorch preventing maximum temperature beyond which product scorching would occur under the overall conditions of the operation. If the supervisory signal $T_i$(SUPERV.) does not exceed the predetermined scorch preventing set point signal $T_i$ (MAX), it passes unchanged as block 75 output via line 22*b* as the $T_i$ set point signal for processing in PID-3 block 26 (FIG. 4).

In conventional manner, in PID-3 block 26, an operating $T_i$ set point bias input is fed via line 26*a* along with the prevailing measured value $T_i$ signal as feedback input fed via line 21*cc* for processing the $T_i$ set point signal input fed via line 22*b*, thereby producing as output in lines 22*c* and 22*cc* a control signal for adjusting the fuel valve 16 and in turn the fuel supply rate to achieve an inlet air dry bulb temperature $T_i$ for the air entering the dryer 4 which corresponds to the desired optimum product feed rate and air flow rate without product scorching based upon the prevailing $T_0$ and RH measurements and $T_w$ value determined therefrom.

In the event the dryer operation load conditions vary so as to change the prevailing measured values $T_0$ and RH such that the desired optimum inlet air dry bulb temperature operating value needed to achieve the predetermined (constant) set point X moisture content in the dried product would otherwise exceed the predetermined scorch preventing maximum temperature, block 75 will limit the supervisory signal $T_i$(SUPERV) to the set point $T_i$ (MAX) value.

Under this limitation, to avoid product underdrying at the resultant maximum inlet air dry bulb temperature operating value which is less than that needed to maintain the predetermined set point X moisture content in the dried product, the supervisory signal $T_i$(SUPERV.) is separately processed in comparison function block 73 as a positive input, to which the set point value signal $T_i$ (MAX) is also separately fed, here as a negative input. The difference output from block 73 is processed in the function generator block 74 and fed via line 22*f* as feedback input to PID-2 block 25 (FIG. 4) along with the feed rate set point signal via line 25*a* and the prevailing measured value of the conveyor speed S via feedback line 25*b*.

Whereas under normal conditions, the block 25 output control signal in line 25*c* will maintain the conveyor drive 3 at the optimum predetermined speed corresponding to the optimum predetermined product feed rate, where the supervisory signal $T_i$(SUPERV.) in line 22*a* exceeds the predetermined scorch preventing maximum temperature $T_i$ (MAX), a proportional difference signal will pass per block 73 and block 74 processing as an adjusted supervisory bias signal to adjust in turn the product feed rate by reducing the speed of the conveyor drive 3 thereby compensating in terms of an extended drying time and reduced product feed rate for the proportional difference between the optimum temperature operating value and the scorch preventing maximum permitted temperature, so as to prevent product underdrying and not exceed the upper moisture product reject level limit (FIG. 8).

On the other hand, in the event the dryer operation load conditions vary so as to change the prevailing measured values $T_0$ and RH such that the desired optimum inlet air dry bulb temperature operating value needed to achieve the predetermined (constant) set point X moisture content in the dried product would otherwise go below the predetermined optimum minimum temperature $T_i$ (min) at which the overall operation for achieving the predetermined moisture content X can proceed at optimum minimum fuel supply rate for the predetermined optimum product feed rate and air flow rate, block 71 will adjust for this deficiency.

Specifically, the predetermined minimum temperature $T_i$(min) signal is fed as positive input to comparison function block 71, to which the supervisory signal $T_i$ (SUPERV.) in line 22*a* is also fed as a feed back negative input. The proportional difference signal output from block 71 is processed in function generator block 72 for producing as output in lines 21*e* and 21*ee* a control signal for adjusting the damper 8 and in turn the air flow rate by reducing the air flow rate, and thereby compensating in turns of a slower drying air supply for the proportional difference between the permitted predetermined optimum minimum temperature $T_i$ (min) operating value and the even lower supervisory value, so as to prevent product overdrying and not go below the lower moisture product reject level limit (FIG. 8).

In conjunction with the function of the control signal as output from block 72, this is also fed as a return signal via line 21*e* to the $K_1$ damper position block 52 of the low block 21, whereby to adjust in turn the input to block 52 in accordance with the proportional difference leading to the change in the position of the damper 8 for reducing the air flow rate dependent signal in the processing carried out in load block 21.

Of course, where the supervisory signal in line 22*a* to block 71 is not below the predetermined minimum temperature $T_i$(min), the output control signal via lines 21*e* and 21*ee* to the damper 8 and the return signal via line 21*e* to logic block 21 are not adjusted, and in this manner the processing in block 71 and 72 is analagous to the processing in blocks 73, 74 and 25 of the supervisory signal for unadjusted operation of the conveyor drive 3 when the supervisory value corresponding to the optimum $T_i$ temperature operating value does not exceed the scorch preventing maximum temperature $T_i$ (max).

In the preferred instance where preheating steam is used as supplemental energy supplied to the fuel as main energy supply for heating the inlet air, the fuel supply is regulated for optimum minimum fuel usage, such that any excess energy needed beyond that of the optimum minimum rate of fuel usage i.e. taken as a fuel rate maximum and corresponding to a maximum flow fuel valve position, is contributed by supplemental steam.

Thus, the output control signal in line 22c for the fuel valve 16 (FIG. 6) is also fed as a feedback positive input to comparison function block 76, to which is also fed a maximum flow fuel valve position signal as a negative input. The block 76 output is processed in function generator block 77 for producino an adjusting control signal as output in line 22e for adjusting the steam valve 11 to admit supplemental steam for preheating the air to the proportional extent that the required total energy for achieving the supervisory value corresponding to the desired optimum air inlet dry bulb temperature operating value exceeds that energy which can be provided by the fuel at the maximum fuel flow open position corresponding to the maximum fuel supply rate of the valve 16 for observing optimum minimum fuel usage.

As will be appreciated the various fixed function blocks of the logic blocks 21 to 23 (FIGS. 5 to 7), and of the associated PID blocks 24 to 26 (FIG. 4) may be readily implemented in conventional manner by distributed process controls such as distributed microprocessors e.g. for providing information regarding energy inventory, efficiency trends, etc. to monitor the overall drying operation.

Since the underlying goal is high profitability for a given product quality at maximum productivity and minimum energy cost, normally the product feed rate will be at its rated maximum value for a desired X value in the dried end product and the air flow rate will be at its rated optimum efficiency in terms of the $K_1$ value for the given installation and product, whereas the fuel feed rate (plus any supplemental steam in the case of a combined energy feed rate) will be at its rated minimum value for maintaining an optimum $T_i$ operating value per the supervisory signal in line 22a for achieving the most efficient inlet air driving force ($T_i$-$T_w$) and outlet air driving force ($T_0$-$T_w$) ratio for such desired X value.

Hence, the product feed rate will only be offset by a temporary reduction when the set point control value for $T_i$ in line 22b is below the fuel condition value needed for maintaining a supervisory value for $T_i$, due to the scorch preventing temperature limitation provided by block 75 and underdrying would otherwise occur. The air flow rate will only be offset by a temporary reduction via an adjustment of the $A_1$ value when the signal for $T_i$ in line 22a is below the minimum fuel condition value needed for maintaining an efficient operation, and overdrying would otherwise occur at the normal air flow rate.

On the other hand, the fuel feed rate (plus any supplemental steam in the case of a combined energy feed rate) will be offset by a reduction when the value for $T_i$ would otherwise exceed the scorch preventing $T_i$ temperature operating value.

In essence, the desired predetermined final moisture content X in the dried product can be achieved independently of the product load conditions, and specifically of the moisture level of the starting wet product for a particular drying installation. This is because for a given $K_1$ value product characteristics based scorch preventing $T_i$(max) and fuel inefficiency preventing $T_i$(min), the product feed rate adjusting conveyor speed S of the drive 3 and air flow rate adjusting damper 8 can be varied relative to the fuel supply adjusting fuel valve 16 (and steam valve 11 where steam is used) for attaining the optimum inlet air temperature $T_i$ operating value within the fixed $T_i$ (max) and $T_i$(min) limits needed to dry the product to the fixed moisture content X.

Specifically, if the load variations indicate less water need be removed to attain the final moisture content X, the $T_i$ operating value can be accordingly decreased, but if this would mean that such operating value would go below the inefficiency preventing $T_i$ (min), the $T_i$ operating value would be limited (increased) to $T_i$(min) per return signal control in line 21e between blocks 72 and 52, and the air flow rate would be reduced by adjusting the damper 8 a compensating amount to prevent overdrying while fuel would be used at an efficient $T_i$ (min) rate.

On the other hand, if the load variations indicated more water must be removed to attain the final moisture content X, the $T_i$ operating value can be accordingly increased, but if this would mean that such operating value would exceed the scorch preventing $T_i$(max), the $T_i$ operating value would be limited (reduced) to $T_i$ (max) and the product feed rate would be reduced by adjusting the conveyor drive 3 a compensating amount to prevent underdrying as well as scorching.

Should the rated maximum fuel flow open position of fuel valve 16 be limited for cost efficiency or other purposes, in conjunction with the use of steam as supplemental heat energy supply then in any case where the maximum fuel flow would be insufficient to attain the desired $T_i$ operating value, steam valve 11 would be opened a compensating amount to make up for the deficiency, i.e. subject to the scorch preventing $T_i$(max) control restriction.

Thus, whereas conventional methods of controlling moisture in continuous drying systems, operated with otherwise autonomous PID loop based on an exit temperature set point of the exhaust or outlet air, by merely manipulating the heater fuel flow rate, are inherently sensitive to disturbances caused by variations in the inlet air moisture, initial product moisture and product flow rate, or load, such disadvantages are overcome by the present system in which a supervisory strategy is utilized for direct or tight control of product moisture using temperature feedback indications rather than product moisture measurements.

More particularly, according to the present invention supervisory control of the continuous dryer is effected by direct control of product moisture by direct inference from measurements of the actual dry bulb temperature $T_i$ of the entering or inlet air to the dryer and the dry bulb temperature $T_0$ and relative humidity RH of the exiting or exhaust air from the dryer and from a determination of the wet bulb temperature $T_w$ from the $T_0$ and RH measurements.

The instant supervisory system accepts a signal representing the inferred moisture value, per processing of the appropriate measured values utilizing the aforesaid equations and the relationships of the values represented therein, and contemplating inclusion of predetermined values corresponding to system constraints to prevent scorching, overdrying and underdrying of the product, for developing controllable inlet and outlet temperature set points and a set point for the outlet temperature controller, based on a 2-level control in terms of $T_i$ (max) and $T_i$ (min) operating temperatures.

FIG. 8 shows a graph of the relationship between the product moisture ratio X and time, ranging from a lower reject level limit of product moisture, at which the final product moisture is less than the desired predetermined minimum amount and an upper reject level limit of product moisture, at which the final product moisture exceeds the desired predetermined maximum amount. Between these limits are plotted the various $\Delta X$ of such moisture for continuous drying carried out in accordance with conventional controlled per line C, average value $X_2$ and carried out in accordance with the improved control of the present invention per line I, average value $X_1$.

It is clear from FIG. 8 that the supervisory control system of the present invention provides faster and more complete damping of oscillations corresponding to disturbances traceable to changes in the conditions of the continuous dryer operation with time.

The commercial significance of a uniformly obtained scorched free dried product is self-evident, e.g. in the case of paper, textiles and other combustible materials, and the same is true of a uniformly obtained dried product which is not underdried, e.g. in the case of particular products specifications. Apart from instances where the particular product specifications require essentially water-free condition in the dried product, however, overdrying to below a given moisture content represents an unnecessary expenditure of fuel, and in this instance the control system of the present invention is of specific advantage.

For instance, in the case of a scorch prone product containing both bound (chemically present) and unbound (physically present) water and where the product specifications permit moisture tolerances overlapping the demarcation point between a lower moisture level in the bound range and a higher moisture level in the unbound range (i.e. containing the total chemically bound water and a marginal tolerance excess of some physically present water), the precise control system of the present invention permits the production of a dried product still containing unbound water and without the need to target the fuel supply rate at a higher level and consequent higher cost to assure that the product will meet the lower moisture level chemically bound range limit.

Since more heat energy must be expended to remove chemically bound water from a material than to remove its corresponding physically present water content, and since chemically bound water is only removed after the physically present water has evaporated, by precise control of the drying operation as contemplated herein to dry the product to a point where it still contains unbound water yet meets the product moisture tolerance product specifications, no energy will be expended at all in removing chemically bound water, and this energy represents a distinct cost reduction.

In practical industrial scale continuous drying operation terms, therefore, important advantages of the improved supervisory control per the present invention include:

(1) the saving of energy (reduced fuel and steam costs) by tighter control of the moisture content of the product (FIG. 8);

(2) increased production (increased profit) for a given sized dryer, e.g. where the dryer is otherwise a bottleneck or low throughput component in an overall continuous production installation;

(3) increased product weight (increased profit where product sold by weight) due to correspondingly higher moisture content permitted in product while still observing acceptible moisture level limits (FIG. 8); and (4) reduced chance of fire and particulate emission, e.g. where product is subject to scorching etc., due to corresponding supervisory quality control.

The following example is set forth by way of illustration and not limitation of the present invention.

EXAMPLE

A conveyor type adiabatic continuous dryer according to the installation shown in FIG. 4 is conventionally operated under the following conditions:

| | |
|---|---|
| Product feedrare | M = 7500 Lbs solid/hr |
| Energy for drying | $Q_1$ = 360 Btu/lb solid |
| Operating temperature | $T_0$ = 260° F. |
| Fuel Cost | $C_f = 5 \times 10^{-6}$ \$/Btu |
| Thermal efficiency | n = 0.85 |
| Annual operating time | 8000 hrs/yr |
| Profit per unit product | P = 0.20 \$/lb solid |
| Sale price | S = 0.60 \$/lb solid |

It is determined according to the supervisory control system of the present invention that by tight controls the operating temperature $T_0$ can be increased by 60° F. i.e. from 260° F. to 320° F., and that the average moisture in the final product can be increased by 0.5% (0.05) of product weight i.e. based on the product solid on a dry solid basis. A reduction in evaporation energy from 938.8 Btu/lb at 260° F. to 895.3 Btu/lb at 320° F. is observed.

(1*a*) Energy saving for increased temperature: the reduced energy use is $$360 \times 895.3/938.8 = 343.3 \text{Ptu/lb solid}$$

This represents a saving of 16.7 Btu/lb solid (i.e. 360–343.3).

The normal fuel cost is $$7500 \times 360 \times 8000 \times (5 \times 10^{-6})/0.85 = 127{,}058 \text{ \$/yr.}$$

The annual fuel saving is $$16.7 \times 127{,}058 = 5894 \text{ \$/yr.}$$

The excess energy of the system due to the increased temperature of the exhaust air in line 17 is advantageously recovered in the economizer 7. Thus, the normalized energy saving for a 60° F. increase in the operating temperature is:

$$16.7/360 = 4.6\% \text{ or } 5893/127{,}0.58 = 4.6\%.$$

(1b) Energy saving for increased moisture:

$$0.05 \times 7500 \times 895.3 \times 8000 \times (5 \times 10^{-6})/0.85 = 1579 \text{ \$/yr.}$$

Here, the evaporation enthalpy (heat content h per unit mass in Btu per lb) at 320° F. is used to avoid duplication in savings calculations. Note that the saving is about 1.2% for the 0.5% increase in permitted moisture (i.e. 1579/127,058 = 1.2%).

This more direct estimate for savings is based on FIG. 8, considering the moisture increase $\Delta X$ in lbs water/lb solid, due to the improved control according to the present invention. Normally, the energy cost is equal to the fuel cost/thermal efficiency:

$$(5\times10^{-6})/0.85=5.9\times10^{-6}\ \$/\text{Btu}$$

It will be noted that this cost of evaporation energy at the dryer is higher than the fuel cost ($5\times10^{-6}$ \$/Btu). Since there may be various energy sources, the net cost of the drying agent heating energy is used instead as is implicit from the foregoing.

(2) Increased production (increased profit) for the dryer at increased moisture:

$$0.05\times7500\times0.20\times8000=60{,}000\ \$/\text{yr.}$$

(3) Increased product weight (increased profit) at increased moisture content in sold product:

$$0.05\times7500\times0.60\times8000=180{,}000\ \$/\text{yr.}$$

(4) The additional benefits of reduced chance of scorching or fire and reduced emissions, especially given present date concerns with minimizing environmental pollution are inherent in the above and per the higher moisture content permitted in the final product in accordance with the supervisory control system of the present invention.

It is clear from the foregoing that the improved control system of the present invention provides savings and trouble free operation. Such lends itself to achieving for example a 1 to 3 year payback period which can be regarded as a relatively high return on investment in retrofitting an existing continuous drying installation with the supervisory control system of the present invention.

In addition to the economic benefits which are more easily quantified, there are associated improved quality aspects of product processing which result from the supervisory control system for continuous dryers according to the present invention. More specifically, where the moisture content is part of the product specification, as in the case of such products as pharmaceuticals, undesired off-specification product production can be costly. These undesired costs concern wasted raw materials, cost of reprocessing or disposal thereof, lost time, missed shipments, etc. Such are avoided by the tight controls provided by the supervisory system of the present invention.

In review, specific primary benefits of the present invention include:

1. Accurate control of product moisture for a minimized energy cost, per the control via logic block 21 (FIG. 5). Functional relations f(x) of the dryer model, damper position parameter $K_1$ and accurate estimation of the wet bulb temperature $T_w$ per logic block 23 (FIG. 7) provide the result by way of a novel combination, whereby minimized fluctuations in product moisture occur which permit in turn a minimized energy cost while meeting end product moisture requirements, i.e. by increasing the average product moisture yet still keeping the maximum moisture thereof below the product reject level, (FIG. 8).

2. Maximized dryer thermal efficiency by maximized temperature $T_i$ while still providing a quality product. This is accomplished by the quality block 22 (FIG. 6). If the supervisory value $T_i$ should fall below a predetermined value $T_i$ (min) for a maximized efficiency the damper 8 is simply moved to reduce the air flow which in turn increases $T_0$ and $T_w$ to achieve a correspondingly higher supervisory $T_i$ level, i.e. $T_i$ (min), through logic block 21 (FIG. 5) in accordance with a novel concept. At the same time the quality of the product is maintained i.e. no scorching occurs by reason of the provision for a selective override control to limit the supervisory value $T_i$ to $T_i$ (max) and a compensating reduced feed rate per the logic of quality block 22 (FIG. 6).

3. Derivative benefits related to items 1 and 2 above include:

(a) increased production (if the dryer otherwise represents a bottleneck in an overall operation) and concomitant increased profit;

(b) increased profit directly attributable to the increased moisture in the end product (if sold by weight).

4. Accurate measurement of $T_w$ per logic block 23 (FIG. 7) in conjunction with related prior logic block developments (See for instance U.S. Pat. No. 4,474,027 to Kaya, A. et al) for use in the system operation contemplated herein.

5. An overall supervisory dryer control system (FIG. 4) including a novel combination of a 2-level (maximum-minimum) control application arrangement, plus an integrated control system including control of the preheater 9 as an alternate or supplementary energy source.

6. An inovative use of function blocks of simple nature applied to a supervisory dryer control system in a novel combination arrangement, without the need for high level computer program or centralized computers that inherently increased data processing time due to the associated need for compiling and computation, and whose programs require specialized personnel.

While specific embodiments of the invention have been shown and described in detail to illustrate the application of the principles of the invention, it will be understood that the invention may be embodied otherwise without departing from such principles.

What is claimed is:

1. Supervisory control arrangement system for controlling the operation of a dryer for the continuous drying of a moist solid product with a gaseous drying medium such as air for close control of the dried product moisture, which comprises:

temperature determining means for determining the wet bulb temperature of the medium in the dryer from the measurements of the prevailing outlet dry bulb temperature and outlet relative humidity of the medium in the dryer, supervisory adjustment means for determining from the measurements of the prevailing inlet dry bulb temperature and outlet dry bulb temperature of the medium in the dryer and from the determined wet bulb temperature a supervisory value corresponding to the energy supply rate of the heating energy supply needed for heating the medium to an optimum inlet dry bulb temperature operating value for drying the product to a predetermined moisture content at a predetermined medium flow rate and a predetermined product feed rate to the dryer, and for producing from the supervisory value in relation to the measurement of the prevailing outlet dry bulb temperature a corresponding supervisory signal, and;

supervisory control means including energy supply control means for limiting the supervisory signal to a set point value which does not exceed a predetermined maximum supervisory value corresponding to a predetermined maximum energy supply rate for heating the medium to a predetermined maximum inlet dry bulb temperature operating value, and for producing from the set point value limited signal in relation to the measurement of the prevailing inlet dry bulb temperature a corresponding energy control signal for controlling the energy supply for heating the medium to an optimum inlet dry bulb temperature operating value which does not exceed said predetermined maximum operating value, whereby to prevent product scorching.

2. System of claim 1 wherein the supervisory control means includes medium flow control signal producing means for producing a flow adjustment signal when the supervisory signal is below a predetermined minimum supervisory value corresponding to a predetermined minimum energy supply rate for heating the medium to a predetermined minimum inlet dry bulb temperature operating value, and for producing from the flow adjustment signal a corresponding medium flow control signal for reducing the medium flow rate in proportion to the difference between the supervisory signal value and the predetermined minimum supervisory value, and means for feeding back the medium control signal to the adjustment means for adjusting the supervisor value independent upon the medium control signal and the thereby reduced medium flow rate, and for producing an adjusted supervisory signal relative to the adjusted supervisory value, whereby to prevent product overdrying.

3. System of claim 1 wherein the supervisory control means includes product feed rate control signal producing means for producing a feed adjustment signal when the supervisory signal exceeds said predetermined maximum supervisory value, and for producing from the feed adjustment signal a corresponding bias signal for reducing the product feed rate in proportion to the difference between the supervisor signal value and said predetermined maximum supervisory value, whereby to prevent product underdrying.

4. System of claim 1 wherein the energy control signal is arranged for controlling a basic supply of heating energy, and the supervisory control means includes supplemental heating energy control signal producing means for producing a supplemental supply adjustment signal when the energy control signal exceeds a predetermined maximum basic energy value corresponding to a predetermined maximum basic energy supply rate for the basic supply of heating energy, and for producing from the supplemental adjustment signal a corresponding supplemental supply control signal for supplying supplemental energy for heating the medium at a supplemental supply rate in proportion to the difference between the energy control signal value and the predetermined maximum basic energy value.

5. System of claim 1 wherein the temperature determining means, adjustment means and control means each comprise function blocks in a logic arrangement.

6. System of claim 2 wherein the medium flow control signal producing means comprises at least one function block in a logic arrangement.

7. System of claim 3 wherein the product feed rate control signal producing means comprises at least one function block in a logic arrangement.

8. System of claim 4 wherein the supplemental energy control signal producing means comprises at least one function block in a logic arrangment.

9. Supervisory control arrangement system for controlling the operation of a dryer for the continuous adiabatic drying of a moist solid product with air for close control of the dried product moisture, which comprises:

temperature determining means including function blocks in a logic arrangement for determining the wet bulb temperature of the air in the dryer from the measurements of the prevailing outlet dry bulb temperature and outlet relative humidity of the air in the dryer;

supervisory adjustment means including function blocks in a logic arrangement for determining from the measurements of the prevailing inlet dry bulb temperature and outlet dry bulb temperature of the air in the dryer and from the determined wet bulb temperature a supervisory value corresponding to the fuel supply rate of the heating fuel needed for heating the air to an optimum inlet dry bulb temperature operating value for drying the product to a predetermined moisture content at a predetermined air flow rate and a predetermined product feed rate to the dryer and for producing from the supervisory value in relation to the measurement of the prevailing outlet dry bulb temperature a supervisory signal, and; supervisory control means comprising function blocks in a logic arrangement;

the supervisory control means including fuel supply control means comprised of at least one such function block for limiting the supervisory signal to a set point value which does not exceed a predetermined maximum supervisory value corresponding to a predetermined maximum fuel supply rate for heating the air to a predetermined maximum inlet dry bulb temperature operating value, and for producing from the set point value limited signal in relation to the measurement of the prevailing inlet dry bulb temperature a corresponding fuel control signal for controlling the fuel for heating the air to an optimum inlet dry bulb temperature operating value which does not exceed set predetermined maximum operating value, whereby to prevent product scorehing;

the supervisory control means including air flow control signal producing means comprised of at least one such function block for producing a flow adjustment signal when the supervisory signal is below a predetermined minimum supervisory value corresponding to a predetermined minimum fuel rate for heating the air to a predetermined minimum inlet dry bulb temperature operating value, and for producing from the flow adjustment signal a corresponding air flow control signal for reducing the air flow rate in proportion to the difference between the supervisory signal value and the predetermined minimum supervisory value, and means for feeding back the air control signal to the adjustment means for adjusting the supervisory value independent upon the air control signal and the thereby reduced air flow rate, and for producing an adjusted supervisory signal relative to the adjusted supervisory signal, whereby to prevent product overdrying, and;

the supervisory control means includes product feed rate control signal producing means comprised of at least one such function block for producing a feed adjustment signal when the supervisory signal exceeds said predetermined maximum supervisory value, and for producing from the feed adjustment signal a corresponding bias signal for reducing the product feed rate in proportion to the difference between the supervisory signal value and said predetermined maximum supervisory value; whereby to prevent product underdrying.

10. System of claim 9 wherein said supervisory control means includes steam control signal producing means comprised of at least one such function block for producing a steam supply adjustment control signal when the fuel control signal exceeds a predetermined maximum fuel value corresponding to a predetermined maximum fuel supply rate for the fuel used for heating the air, and for producing from the steam adjustment signal a corresponding steam supply control signal for supplying steam for heating the air at a steam supply rate in proportion to the difference between the fuel control signal value and the predetermined maximum fuel value.

11. Supervisory control process for controlling the operation of a dryer for the continuous drying of a moist solid product with a gaseous drying medium such as air for close control of the dried product moisture, which comprises:

feeding the moist solid product to the dryer at a predetermined product feed rate, supplying heating energy for heating the gaseous drying medium, and flowing heated gaseous drying medium which has been heated by the heating energy to the dryer at a predetermined medium flow rate, in conjunction with the steps of;

measuring substantially continuously the prevailing inlet dry bulb temperature, outlet dry bulb temperature and outlet relative humidity of the medium in the dryer;

determining substantially continuously the wet bulb temperature of the medium in the dryer from the measurements of the prevailing outlet dry bulb temperature and outlet relative humidity;

determining substantially continuously from the measurements of the prevailing inlet dry bulb temperature and outlet dry bulb temperature of the medium in the dryer and from the determined wet bulb temperature a supervisory value corresponding to the energy supply rate of the heating energy supply needed for heating the medium to an optimum inlet dry bulb temperature operating value for drying the product to a predetermined moisture content at said predetermined medium flow rate and said predetermined product feed rate to the dryer, and substantially continuously producing from the supervisory value in relation to the measurement of the prevailing outlet dry bulb temperature a corresponding supervisory signal, and;

supervising substantially continuously the operation to prevent scorching, overdrying and underdrying of the product by controlling the supervisory signal, including;

limiting the supervisory signal to a set point value which does not exceed a predetermined maximum supervisory value corresponding to a predetermined maximum energy supply rate for heating the medium to a predetermined maximum inlet dry bulb temperature operating value, and producing from the set point value limited signal in relation to the measurement of the prevailing inlet dry bulb temperature a corresponding energy control signal for controlling the energy supply for heating the medium to an optimum inlet dry bulb temperature operating value which does not exceed said predetermined maximum operating value, whereby to prevent product scorching;

producing a flow adjustment signal when the supervisory value is below a predetermined minimum supervisory value corresponding to a predetermined minimum energy supply rate for heating the medium to a predetermined minimum inlet dry bulb temperature operating value, producing from the flow adjustment signal a corresponding medium flow control signal for reducing the medium flow rate from said predetermined flow rate in proportion to the difference between the supervisory signal value and the predetermined minimum supervisory value, and feeding back the medium control signal to the step of determining the supervisory value and producing the supervisory signal, for producing the supervisory value independent upon the medium control signal and the thereby reduced medium flow rate, and for producing an adjusted supervisory signal relative to the adjusted supervisory value, whereby to prevent product overdrying, and;

producing a feed adjustment signal when the supervisory signal exceeds said predetermined maximum supervisory value, and producing from the feed adjustment signal a corresponding bias signal for reducing the product feed rate in proportion to the difference between the supervisory signal value and said predetermined maximum supervisory value, whereby to prevent product underdrying.

12. Process of claim 11 wherein the energy control signal is used to control a basic supply of heating energy, and producing a supplemental supply adjustment signal when the energy control signal exceeds a predetermined maximum basic energy value corresponding to a predetermined maximum basic energy supply rate for the basic supply of heating energy and producing from the supplemental adjustment signal a corresponding supplemental supply control signal for supplying supplemental energy for heating the medium at a supplemental supply rate in proportion to the difference between the energy control signal value and the predetermined maximum basic energy value.

13. Process of claim 12 wherein the gaseous drying medium is air, the basic supply of heating energy is combustion fuel and the supplemental energy is air pre-heating steam.

14. Process of claim 12 wherein the steps of determining the wet bulb temperature, determining the supervisory value and producing the supervisory signal, limiting the supervisory signal and producing the energy control signal, producing the flow adjustment signal and the medium flow control signal, producing the feed adjustment signal and the bias-signal, and producing the supplemental supply adjustment signal and the supplemental supply control signal, are correspondingly carried out using function blocks in a logic arrangement.

15. Process of claim 11 wherein the steps of determining the wet bulb temperature, determining the supervisory value and producing the supervisory signal, limiting the supervisory signal and producing the energy control signal, producing the flow adjustment signal and the medium flow control signal, and producing the feed adjustment signal and the bias signal, are correspondingly carried out using function blocks in a logic arrangement.

* * * * *